United States Patent [19]

Bacevius

[11] Patent Number: 4,528,622

[45] Date of Patent: Jul. 9, 1985

[54] CLAMPING DEVICE AND ARTICLE HOLDER THEREFOR

[76] Inventor: Joseph G. Bacevius, 780 Bridgeport Ave., Shelton, Conn. 06484

[21] Appl. No.: 446,519

[22] Filed: Dec. 3, 1982

[51] Int. Cl.[3] ..... F21V 21/00

[52] U.S. Cl. ..... 362/396; 362/190; 362/191; 362/269; 362/287; 362/427; 248/316.1; 248/316.5

[58] Field of Search ..... 362/190, 191, 269, 287, 362/396, 427; 248/316.1, 316.5

[56] References Cited

U.S. PATENT DOCUMENTS

| | | | |
|---|---|---|---|
| 4,170,337 | 10/1979 | Davis | 362/72 X |
| 4,390,927 | 6/1983 | Von Feldt | 362/72 |
| 4,399,498 | 8/1983 | Bacevius | 362/396 |

*Primary Examiner*—Stephen J. Lechert, Jr.
*Attorney, Agent, or Firm*—Arthur T. Fattibene

[57] ABSTRACT

A clamping device and holder therefor, and more specifically, a clamping light construction and a holder therefor whereby a light or article can be selectively supported in a variety of angular positions for any given fixed clamped position of the clamping device. Essentially, the clamping device includes a clamp or clip having a specially constructed holder for supporting a device or light in a variety of angular relationships. In one form of the invention, the holder comprises a tubular like member having a plurality of arcuate shaped opening for frictionally receiving and retaining a light device therein for selectively directing the light beam in any of several directions. In another form of the invention, the light or device is provided with one or more slides which are selectively engageable with a keyway connected to the clamping device for varying the angular position of the light or article relative to the clamping device.

16 Claims, 24 Drawing Figures

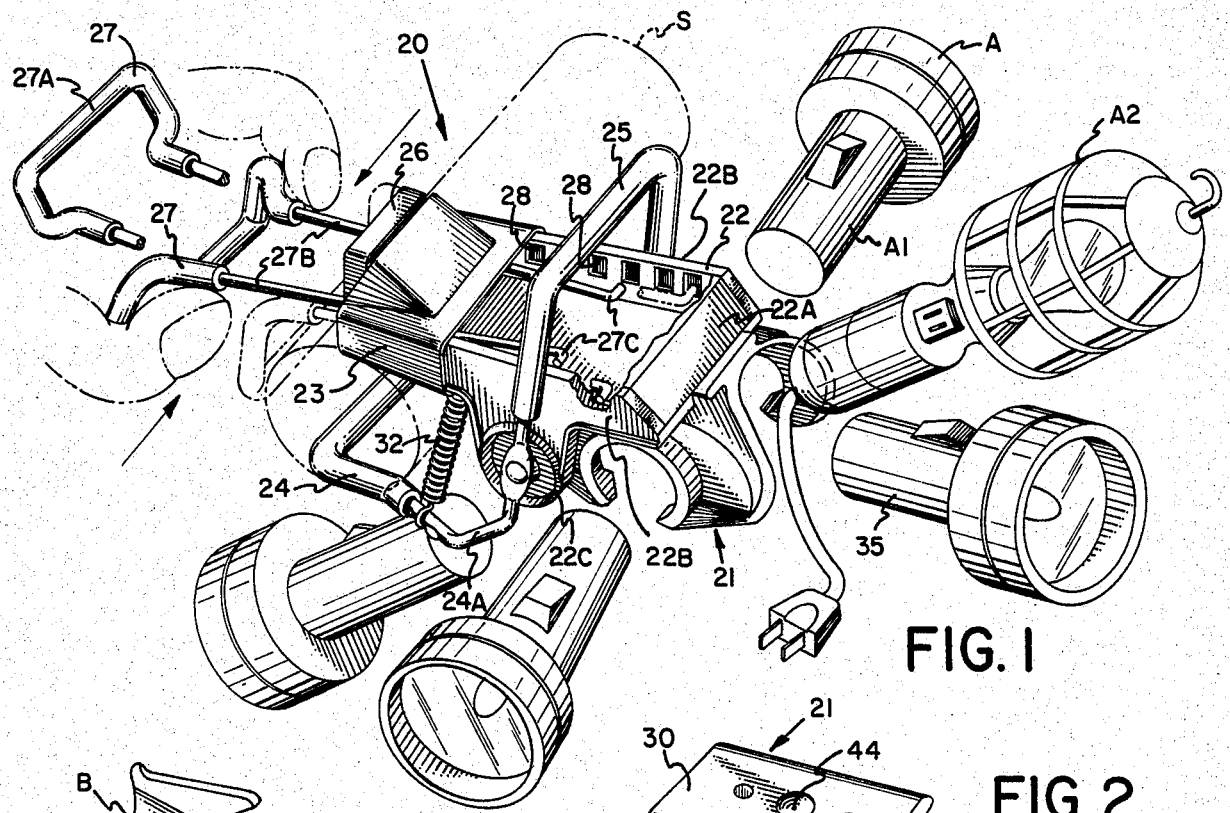
FIG. 1
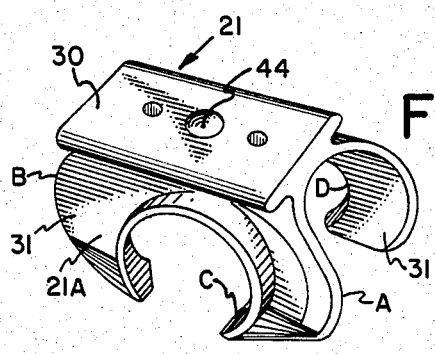
FIG. 2
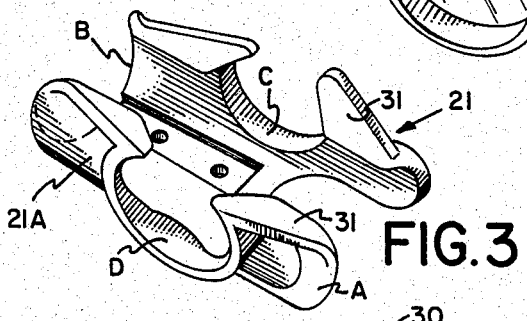
FIG. 3
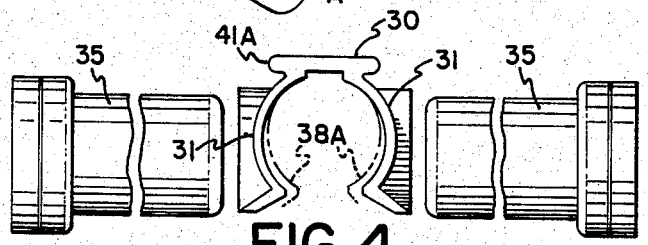
FIG. 4
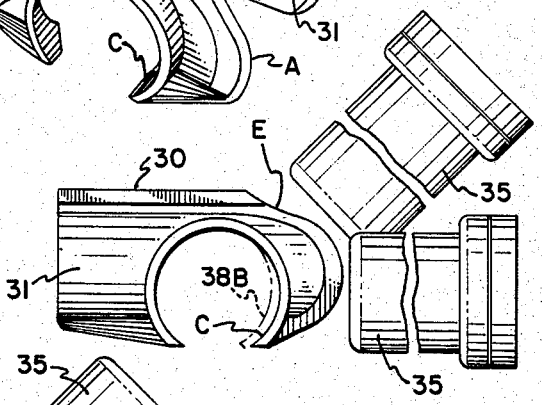
FIG. 5
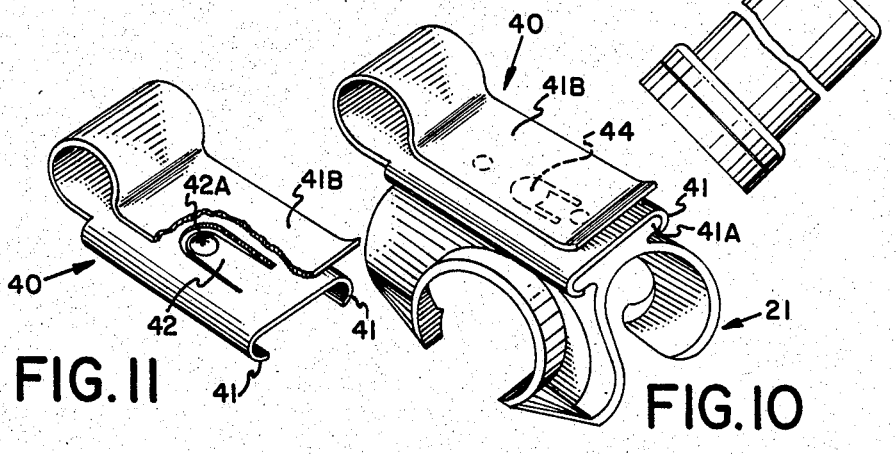
FIG. 11
FIG. 10

S
50
51
52
52A
53
54
54A
54B
55
56
56A
56B
56C
57
58
59
60
60A
61
13

CLAMPING DEVICE AND ARTICLE HOLDER THEREFOR

RELATED APPLICATION

This application contains some subject matter which is common to my pending patent application Ser. No. 107,373 filed Dec. 26, 1979 for Clamping Light Construction and a Clamping Means Therefor, and application Ser. No. 354,029 filed Mar. 2, 1982 for Clamping Light Construction and Clamping Means Therefor.

OBJECT

An object of this invention is to provide an improved clamping device for supporting a light or other device in any of several selectable angular relationships.

Another object is to provide a light or device holder which is relatively simple in construction and which can selectively support thereon a light or other article in any of several positions.

Another object is to provide a clamping light construction for adjustably supporting a light in any of several varying positions in any given clamping position.

Another object is to provide a clamping light structure which is relatively small, compact, and which is positive in operation.

Another object is to provide an improved clamping device capable of holding any conventional flashlight type device in any of several positions.

Another object is to provide a holder capable of supporting an article in any of several different positions.

Another object is to provide an improved clamping device having an extendable jaw portion.

Another object is to provide a clamping light construction wherein the light can be stowed within the clamping portion to define a compact and readily stowable device when not in use.

BRIEF SUMMARY OF THE INVENTION

The foregoing objects and other features and advantages are attained by a clamping device and article holder therefor which comprises essentially a clamp housing having a fixed jaw portion and has pivotally connected thereto a complementary movable jaw portion. The movable jaw portion is preferably formed of a bail member having one end defining a movable jaw and having its other end defining a handle which extends to the opposite side of the housing. A spring is interconnected between the jaw portions for normally biasing the jaws into a gripping position.

The clamp housing opposite to the jaw portion includes a holder which is constructed for supporting a light or other article in any of several different positions in any given clamped position of the device. In one form of the invention, the holder includes a tubular like body portion having a generally arcuate cross-section about a longitudinal axis and which body has formed therein a plurality of arcuate shaped openings to frictionally receive and retain an article or light therein. The respective openings are spaced about the body so that the light or article supported therein can be selectively positioned to be directed in any of several selectable positions.

In another form of the invention, the article holder is operatively connected to a clip as distinguished from a clamp.

In yet another form of the invention, the article or light holder comprises a keyway cooperating with a complementary slide support arrangement which is operatively connected to the light and/or article to be supported. The complementary slide support includes a plurality of slides spaced about the article whereby the relative position of the article is selectively determined by which slide is disposed in engagement with the keyway connected to the clamping device.

FEATURES

A feature of this invention resides in the provision of an improved clamping device and holder therefor for supporting a light or article in any of several different angular positions whereby the article is snap fitted to the holder.

Another feature of the invention resides in an article holder which comprises of a unitary tubular body portion having a plurality of openings formed therein for frictional securing a conventionally shaped article therein in any of several selectable positions.

Another feature of this invention is to provide a clamping device having a keyway for slidably receiving a complementary slide which is connected to the article to be supported.

Other features and advantages will become readily apparent when considered in view of the drawings and specifications in which:

FIG. 1 is a perspective view of the clamping device illustrated as a light holder and illustrating the various positions in which a light may be supported thereon in any given clamping position.

FIG. 2 is a detailed top perspective view of the article holder of FIG. 1.

FIG. 3 is a detailed bottom perspective view of the holder of FIG. 2.

FIG. 4 is a detailed front end view of the holder illustrating lateral light supporting positions.

FIG. 5 is a side elevation view of the holder illustrating forward upwardly and downwardly light holding positions.

Figure 9:
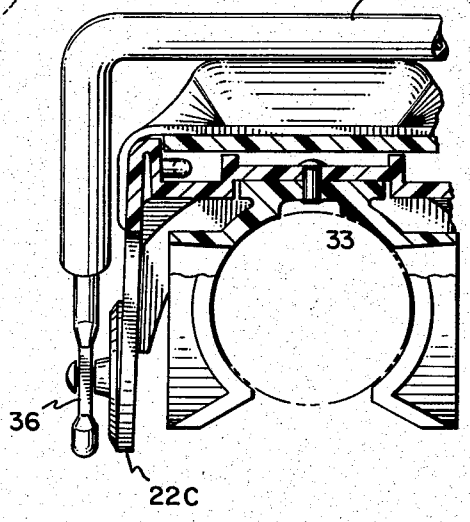
Figure 6:
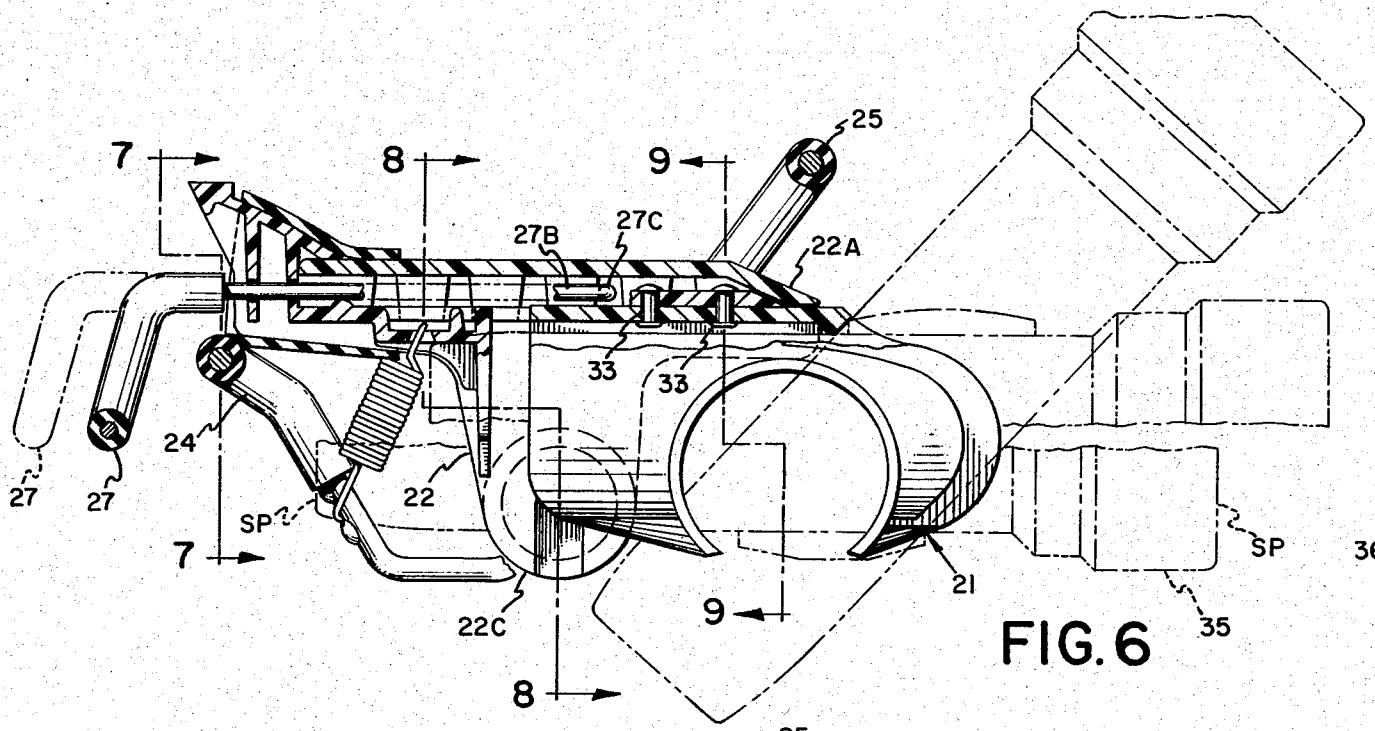
FIG. 6 is a detailed cross-sectional view of the clamping device of FIG. 1 illustrating the light in various operative holding positions and in a stowed position.
Figure 8:
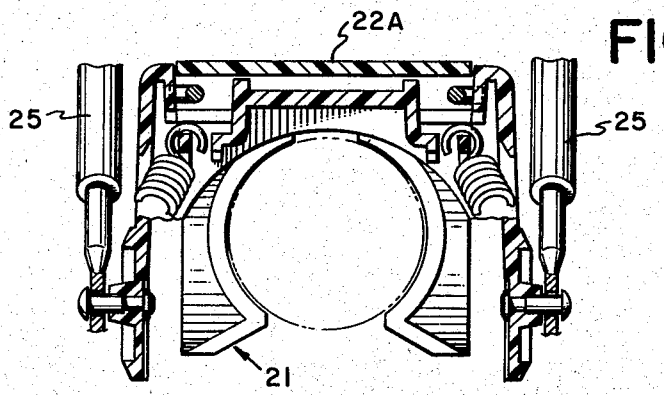
Figure 7:
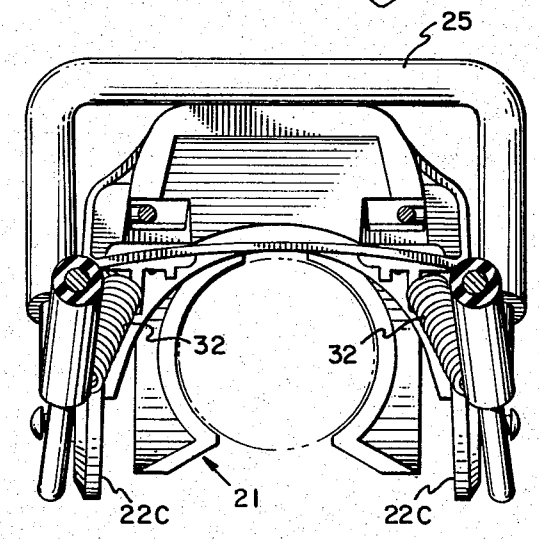

FIGS. 7, 8 and 9 are respective sectional views taken along lines 7—7,8—8, and 9—9 respectively on FIG. 6.

FIG. 10 is a perspective view of a modified form of the invention illustrating the holder of FIGS. 2 and 3 with a clip.

FIG. 11 is a detailed perspective view of the clip of FIG. 10.

Figures 12, 13, 14, 15, 16, 17, 18, 19, 20, 21, 22, 23, 24:
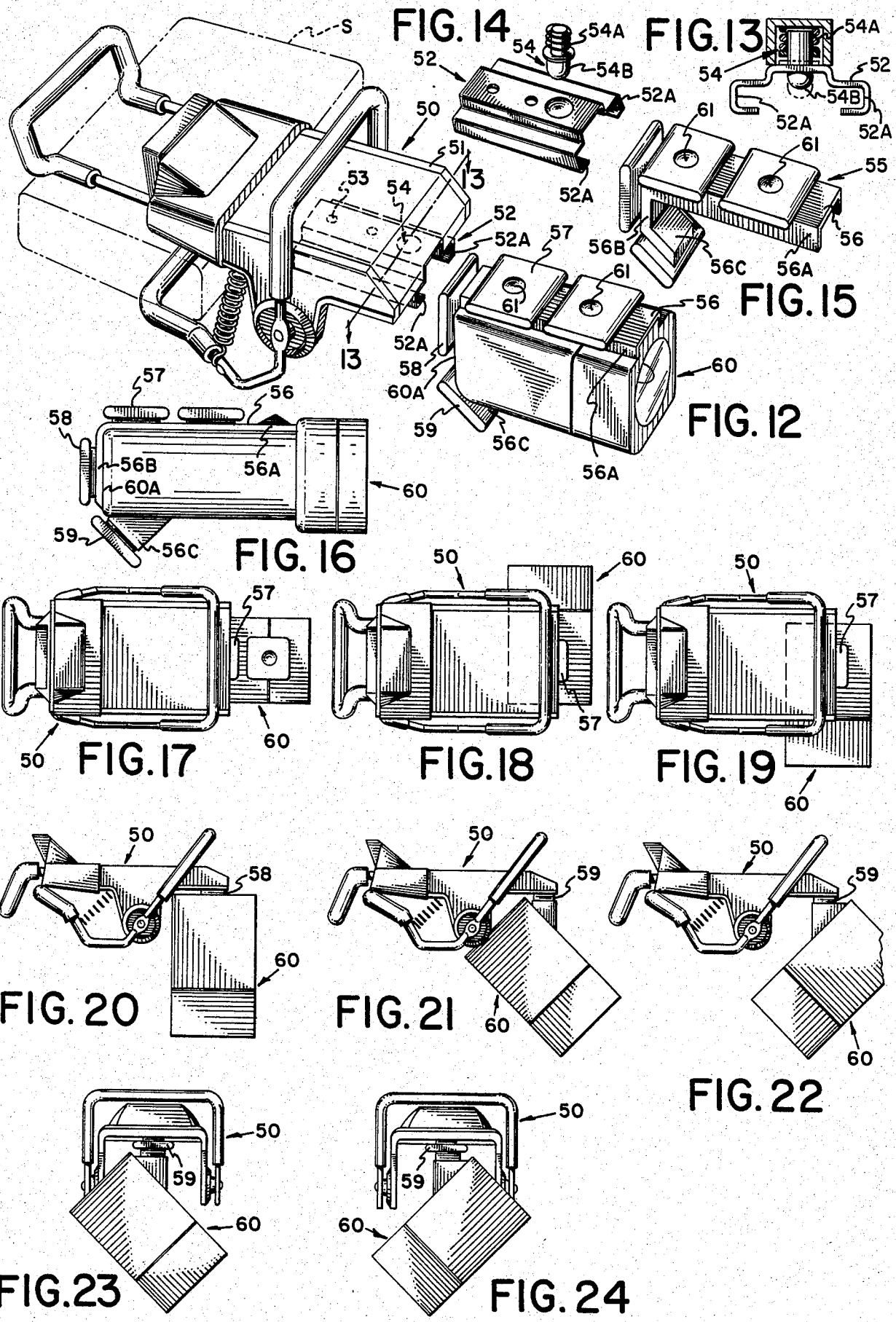

FIG. 12 is a perspective exploded view of another modified form of the invention.

FIG. 13 is a detailed sectional view of a component part taken on line 13—13 on FIG. 12.

FIG. 14 is a perspective view of the keyway of FIG. 12.

FIG. 15 is a perspective view of the slide assembly of FIG. 12.

FIG. 16 is a detailed side view of the lighting device of FIG. 12.

FIGS. 17, 18, 19, 20, 21, 22, 23, and 24 respectively are various views illustrating the various selective positions a lighting device can be supported by the clamping device of FIG. 12.

DETAILED DESCRIPTION

Referring to FIGS. 1 to 9, there is shown therein clamping device 20 and an associated article holder 21 for selectively holding an article A in any of several selectable positions in any given clamping position of the clamping device 20. In the illustrated embodiment, the article A comprises a light, such as a conventional one, two or more cell type flash lights $A_1$ or conventional A.C. type of extension light $A_2$.

The clamping device 20 comprises essentially of a clamp housing 22 which includes a relatively wide top portion 22A having opposed depending side wall portions 22B, 22B to define a generally channel shaped housing. The rear end portion of the housing defines a fixed jaw portion 23. Intermediate the ends of the respective side walls 22B, 22B there is provided a trunnion 22C which defines the pivot for the movable jaw 24. As shown, the movable jaw 24 is defined by an endless bail member 24A which is angularly bent so that one end defines the movable jaw 24 for complementing the fixed jaw 23 and the other end of the bail member 24A extends to the other side of the fixed jaw 24 to define a handle 25. A spring or spring means 32 is interconnected between the fixed jaw 23 and movable jaw 24 so as to normally bias the movable jaw toward the fixed jaw 23. Connected to the front of the fixed jaw is a raised finger grip 26 to facilitate the opening of the jaws in a manner similar to that described in my copending application Ser. No. 107,373, Dec. 26, 1979 now U.S. Pat. No. 4,376,965, issued Mar. 15, 1983, and Ser. No. 354,029 filed Mar. 2, 1982 now U.S. Pat. No. 4,399,498, issued Aug. 16, 1983.

Operatively connected to the fixed jaw is a jaw extension 27. As shown, the jaw extension comprises a bail member having a cross portion 27A and connected elongated leg portions 27B, 27B. Each of the leg portions 27B, 27B is provided with a laterally outwardly bent portion at the free end thereof as indicated at 27C. As best seen in FIG. 1, the opposed leg portion 27B, 27B extend along the inner surface of the clamp housing side walls 22B. Formed along the inner surface of the respective side walls 22B, 22B are a plurality of spaced detent recess 28 for adjustably receiving the laterally bent ends 27C in the adjusted position. Thus, as seen in FIG. 1, the jaw extension 27 can be readily extended by simply applying a squeezing force on the opposed leg portions 27B, 27B as shown to disengage the lateral bent ends 27C from its associated detent recess 28 and advancing it to the next recess 28. The inherent resiliency of the leg portions 27B, 27B will retain the jaw extension in the adjusted position upon the release of the squeezing force applied thereto. Also, as shown in FIG. 1, the jaw extension 27 can be reversed to extend either in an upwardly direction wherein the cross portion can function as a finger grip to facilitate the opening of the clamp. When extension 27 is in upward direction, the clamp can be used for parallel biting or gripping as also illustrated in FIG. 12, or in a downwardly position where the cross piece functions as an extended gripping and locking jaw.

In accordance with this invention, an article holder 21 comprises a generally tubular body 21A having a top portion or wall 30 and opposed depending side wall portions 31—31. As shown in the illustrated embodiment, best seen in FIGS. 2 and 3, the tubular body 21 is generally arcuate in cross-section having a circumferentially extending periphery which is preferably less than 360° and at least greater than 180° . The tubular body 21A is also provided with a longitudinal axis which extends generally longitudinally of the clamp housing 22 as noted in FIG. 1. Thus, as best seen in FIGS. 2 and 3, the tubular body 21A terminates at its opposed ends in arcuate openings A and B which are arranged to frictionally receive and grip a device therein, such as a conventional flash light 35 as noted in FIG. 1. Each of the opposed side wall portions 31—31 of the tubular body 21A is also provided with an arcuate shaped opening C and D respectively which also have circumference of less than 360° and greater than 180°. As schematically shown in FIGS. 4 and 5, the side or lateral opening C and D of body 21A provide a means for frictionally receiving and retaining a light 35 or other device so as to extend laterally to either the left or right. The upper forward position of the top wall 30 is also provided with a notched or cut-out portion to define an angular disposed opening E which is sized and shaped to frictionally receive a light or device at an angle relative to the holder 21. As noted in FIG. 5, such light or device can be angled to be directed either in an upwardly or downwardly position. To firmly retain the flashlight or article with the respective openings A-E, it is preferred that the body 21A be formed of an elastic type material such as plastic, which has some inherent resiliency and/or memory that will permit some expansion of the free ends position of the respective openings A-E that will permit the openings to frictionally receive and retain the light or article in a positive manner. The flexibility of the respective arcuate openings A-E thus defined is schematically shown in FIGS. 4 and 5 by the broken line showing as indicated at 38 and 38B.

In the embodiment of FIG. 1, the holder 21, as herein described, is secured to the under surface of the clamp housing by suitable connectors such as screws, rivots or other suitable fasteners 33. If desired, the top wall 30 of the holder 21 may be formed to define a slide which can be removably connected to the clamp housing 22 by providing the clamp housing with a keyway adapted to slidably receive the slide portion of the holder, in a manner illustrated in FIG. 12 and as will be hereinafter described.

In the illustrated clamping device of FIGS. 1 to 6, an arrangement is provided whereby the holder 21 can support an article such as a flash light or other device in at least five angular positions in any given set clamped position. The five variable holding positions are schematically illustrated in FIG. 1 and in FIGS. 4 and 5 respectively.

As noted in FIG. 6, the clamping housing constructed as defined also provides an arrangement whereby the light 35 can be compactly stowed within the clamp housing 22 as indicated in position SP—SP. This feature enables the combined assembly of clamp and light to be compactly stored or packaged as a unit in a relatively small area, e.g. in the glove compartment of a car, a tool box or other such limited area. Also, to minimize the overall height of the clamping device, the bail member defining the movable jaw 24 and associated handle 25 may be provided with a flattened portion 36 at the bend thereof. Thus, as best seen in FIG. 6, the overall height of the clamping device need be only slightly greater than the diameter of the light or article retained by the holder 21.

It will be apparent that the clamping device can be firmly fixed to a support S at any desired angular relationship, and when combined with the versitility of the variable angular setting of the light or device relative to its holder, the beam of light or article can be directed in virtually an unlimited number of different directions. The clamping device therefore has universal application and may be used as a light holder for directing lighting to any given area and/or at any desired angle, and/or can be used to support a tool or other suitable article capable of being frictionally retained in the openings A–E of the article holder 21. Also, the clamping device can be firmly attached to most any type of support S, be it round, square, flat or irregular in shape, so long as the support S can be grasped within the maximum opening of jaws 23 and 24, and which jaw opening can be further enlarged by use of the jaw extension 27.

FIGS. 10 and 11 illustrate a modified form of the invention wherein the holder 21 as defined in FIGS. 2 to 6 can be utilized with a clip 40 which may be attached to one's belt, pocket, clipboard or the like. In this form of the invention, the holder 21 is detachably connected to a clip 40. As shown, the clip 40 includes a keyway 41 which is arranged to slidably recieve the slide portion 41A which is integrally formed along the top of the holder 21. Blanked out of the plane of the keyway is a leaf 42 which terminates in a detent 42A. The leaf 42 and its detent 42A being resilient will function as a leaf spring for releasably securing the slide portion 41A of the holder 21 within the keyway 41. If desired, the top of the slide 41A may be provided with a detent recess 44 for receiving the detent 42A whereby the holder can be positively secured and retained to the clip 40.

Integrally connected to the keyway 41 is a reversely bent portion 41B to overlie the keyway and to define therewith the clip whereby the holder can be releasably attached to one's belt or pocket. In all other respects, the article or light can be supported in the holder of FIGS. 10 and 11 in a manner similar to that hereinbefore described.

FIGS. 12 to 24 illustrate a modified form of the invention. In this form of the invention, the clamping device 50 is similar in construction to the clamping device of FIG. 1. However, in this form of the invention, a modified article holder 52 is cooperatively associated with the clamp housing 51 of clamp 50. As shown, the article holder includes a means defining a keyway having opposed track portions 52A—52A which is adapted to slidably recieve a slide which is operatively connected to the article to be supported on the clamp device 50. Modified article holder 52 is secured to the under surface of the clamp housing by suitable fasteners 53. Cooperatively associated with the modified article holder 52 is a spring loaded detent 54 which is attached to secure a slide means 55 which is operatively connected to an article adapted to be supported to modified article holder 52.

Referring to FIG. 15, the slide means 55 includes a slide support 56 which has a portion 56A adapted to extend along one side of an article, e.g. a lantern type flashlight 60 and an angularly disposed end portion 56B adapted to engage the end 60A of the light 60. If desired, the end portion 56B may be provided with an angular disposed tail portion 56C. Connected to each portion 56A, B and C of the slide support 56 is a slide 57, 58 and 59 respectively. In the illustrated embodiment, each slide 57, 58 and 59 have their respective side and end portions of substantial equal length so as to be received within the keyway track portions 52A. Also, each slide 57, 58 and 59 is provided with a detent recess 61. As shown in FIGS. 12 and 16, the slide support 56 and its associated slides are suitably connected to the casing of a flashlight 60 so that the respective slides are disposed on at least two sides of the article or light, and angularly disposed to at least one side. With the construction described, it will be apparent that the light 60 can be detachably secured to the modified article holder 52 in at least eight positions for any given clamping position of the clamping device 50. As shown in FIGS. 17 to 19, the light 60 can be supported on the clamping device to direct the light beam either forwardly as shown in FIG. 17, to the left as shown in FIG. 18, or to the right as shown in FIG. 19 when viewing from the top of the clamping device. FIGS. 20 and 22 illustrate the adjustment of the light relative to the clamp for directing the light beam downwardly (FIG. 20) or forwardly and downwardly (FIG. 21) or rearwardly and downwardly (FIG. 22). In FIGS. 23 and 24, the light is illustrated as being supported in the modified article holder 52 as to be directed downwardly to the right and downwardly to the left as viewed from the rear of the clamping device. It will be understood that the positions described are attained simply by sliding the opposite slide and/or by turning the light and sliding the slide into the keyway track portions 52A. Upon alignment of the detent 54 with the detent recess 61 of the respective slides, the light or device is positively secured in place to the clamping device. The arrangement is such that the detent is rendered self-locking as the detent spring 54A exerts a normal biasing force on the detent pin 54B to maintain it in its normal protracted position. Thus, the detent pin 54B is normally extended in locking position when the detent recess 61 of a slide is brought in alignment therewith. By providing the detent pin with a rounded head position, the detent pin is normally cammed into disengaging position when a pulling force is applied to the light when removing it from the keyway track portion 52A.

By rotating the clamping device or inverting the clamping device, the downwardly projected positions of FIGS. 20 to 24 are changed to upwardly directed positions. Thus, by angularly adjusting the relationship of the clamping device 50 to its support S, and by the eight position article holding means described, numerous adjustable positions are made possible.

From the foregoing, it will be apparent that the clamping device and article holder thereof provides a versatile tool for supporting a light or article in any number of directed positions. The arrangement is such that, when not in use, the article can be maintained in a stowed position well within the configuration of the housing as best seen in FIG. 1. While the invention has been illustrated as described as a holder for flashlights and other devices, the device is applicable for supporting other types of tools and/or articles wherein it is desirable to support an article in a selected position and permitting one the free use of both hands.

While the invention has been described with respect to several embodiments thereof, it will be readily appreciated and understood that variations and modifications may be made without departing from the spirit or scope of the invention.

What is claimed is:

1. A multi-positional device holder comprising an elongated tubular like body having a top portion and connected opposed side walls dependently connected to said top portion, said tubular body being generally arcuate in cross-section defining a circumference of less than 360° and more than 180°, said tubular like body terminating in opposed longitudinally aligned arcuate end openings whereby said tubular like body is adapted to frictionally receive and retain a device therein so that the retained device extends longitudinally of said tubular like body, and said opposed side walls having formed therein opposed arcuate shaped side openings disposed therein intermediate the length of said opposed side walls, said walls, said side openings each having a circumference of less than 360° and more than 180°, and said side openings being adapted to frictionally recieve and retain a device therein so as to extend transversely of said tubular body, said side openings being coaxially disposed substantially normal to the longitudinal axis of said tubular like body, whereby the axis of said side openings extend across the longitudinal axis of said tubular like body.

2. A multi-positional device holder defined in claim 1 wherein said body is formed of a resilient material permitting said arcuate shaped openings to be resiliently expanded and inherently contracted to receive and frictionally retain a device therein.

3. A multi-positional device holder as defined in claim 1 wherein said top portion of said body includes a notch defining an opening formed integral with the adjacent end opening for receiving and retaining a device at an angle relative to the longitudinal aixs of said body.

4. A multi-positional device holder as defined in claim 1 and including means defining a slide connected to said top portion, and a support means having a complementary keyway for receiving said slide for supporting the holder thereto.

5. A multi-positional device holder as defined in claim 4 wherein said support means includes a clamp.

6. A multi-positional device holder as defined in claim 4 wherein said support means includes a clip.

7. A multi-positional device holder as defined in claim 6 wherein said clip includes a portion having a keyway for receiving the slide, a spring leaf detent blanked out of the surface of said portion for positively retaining said slide within said keyway, and a reversely bent portion connected to said first mentioned portion to define therewith a spring clip.

8. A multi-positional device holder as defined in claim 4 wherein said clamp comprises support means housing having a front gripping jawportion, a second jaw forming member including a bail member angularly bent intermediate the ends thereof whereby one end defines a jaw portion disposed opposite said front gripping jaw portion, and the other end of said bail member extending to the opposite side of said front gripping jaw portion to define a handle, means for pivoting said bail member intermediate the ends thereof to said clamp housing, a spring means for biasing the jaw portion of said bail member toward said front jaw gripping portions and said holder being connected to said clamp housing.

9. A multi-positional holder as defined in claim 8 wherein said clamp housing includes a top portion and opposed side wall portion defining a generally channel shaped member, said top portion defining said keyway on the under surface thereof for slidably receiving the slide of said holder.

10. A multi-positional holder as defined in claim 9 wherein said clamp includes a jaw extension adjustably connected to said front gripping jaw portion, said jaw extension including a U-shaped member having opposed elongated leg portions, said leg portions each terminating in a laterally outwardly bent detent end portion, and said clamp housing having a plurality of spaced recesses defined along the inner surface thereof for adjustably receiving said lateral bent leg detents to secure said jaw extension in the adjusted position thereof.

11. In a clamping light construction having a clamping means including a first jaw forming member, a second jaw forming member, means for privoting said jaw forming members for relative movement between a gripping and non-gripping position, and means for normally biasing said jaw members toward a gripping position, the improvement of a light holder connected to one of said jaw members, and a light means adapted to be detachably connected to said holder, said holder comprising a top wall and connected depending opposed side walls to define a tubular body having a circumference of less than 360° and greater than 180°, said body having a longitudinal axis and said body terminating in opposed end arcuate openings for resiliently gripping a light means therein, and said body having opposed arcuate shaped side openings disposed in said side walls intermediate the length of said body, said side openings having a circumference of less than 360° and greater than 180° for frictionally receiving and retaining a light means therein whereby the axis of said side openings crosses the axis of said opposed end openings; and said openings being adapted to support said light means in a plurality of support positions for directing a light beam in different directions in a given fixed clamping position of said clamping means.

12. In a light construction as described in claim 11, wherein said holder includes a notch portion formed in the upper surface thereof adjacent to and integral with opening disposed on one end of said tubular holder.

13. A clamping light construction comprising a clamping means including a clamp housing having a jaw forming member, a second jaw forming member, means for pivoting said second jaw forming member to said clamp housing for relative movement between a gripping and non-gripping position, means for normally biasing said jaw members toward a gripping position, a jaw extension adjustably connected to one of said jaw members, said jaw extension including a U shaped member having opposed elongated leg portions, each of said leg portions terminating in a laterally bent detent end portion, and said jaw housing having a plurality of spaced recesses formed along the inner surfaces thereof for adjustably receiving said lateral bent detent ends of said leg portions for securing the jaw extension in the adjusted position thereof, a keyway formed in said clamp housing, and a holder means adapted to be connected to a light means, said holder including a plurality of slides connected thereto whereby the light means can be variously directed by engaging one of said slides in said keyway.

14. In the clamping light construction as defined in claim 13 wherein said holder means includes a slide support having a portion adapted to extend along a side and connected end of a light means, a slide connected to each portion of said slide support, each of said slides being adapted to be slideably engaged with said keyway whereby the direction of light beam is varied accordingly.

15. In a clamping light construction as defined in claim 14 wherein said slide support includes an angularly disposed support portion, and a slide connected to said angularly disposed support portion.

16. In a clamping light construction as defined in claim 14 and including detent means for positively securing said slide in position in said keyway.

* * * * *